US010849429B2

(12) United States Patent
Edalati

(10) Patent No.: US 10,849,429 B2
(45) Date of Patent: Dec. 1, 2020

(54) BODY SUPPORT DEVICE AND METHOD

(71) Applicant: Mohsen Edalati, Kirkland, WA (US)

(72) Inventor: Mohsen Edalati, Kirkland, WA (US)

( * ) Notice: Subject to any disclaimer, the term of this patent is extended or adjusted under 35 U.S.C. 154(b) by 0 days.

(21) Appl. No.: 16/102,514

(22) Filed: Aug. 13, 2018

(65) Prior Publication Data

US 2019/0045933 A1 Feb. 14, 2019

Related U.S. Application Data

(60) Provisional application No. 62/544,333, filed on Aug. 11, 2017.

(51) Int. Cl.

| | |
|---|---|
| ***A47C 7/14*** | (2006.01) |
| ***A47C 7/18*** | (2006.01) |
| ***A47C 7/42*** | (2006.01) |
| ***A47C 7/38*** | (2006.01) |
| ***A47C 7/34*** | (2006.01) |
| ***A47C 7/02*** | (2006.01) |

(52) U.S. Cl.

CPC ..... *A47C 7/14* (2013.01); *A47C 7/18* (2013.01); *A47C 7/383* (2013.01); *A47C 7/425* (2013.01); *A47C 7/029* (2018.08); *A47C 7/34* (2013.01)

(58) Field of Classification Search

CPC ..... A47C 7/34; A47C 7/14; A47C 7/18

See application file for complete search history.

(56) References Cited

U.S. PATENT DOCUMENTS

| | | | | |
|---|---|---|---|---|
| 3,462,779 | A * | 8/1969 | Thompson | A47C 27/063 5/655.8 |
| 3,869,739 | A * | 3/1975 | Klein | A47C 27/064 5/720 |
| 4,429,427 | A * | 2/1984 | Sklar | A47C 27/20 5/654.1 |
| 8,117,700 | B2 * | 2/2012 | Howard | A47C 27/001 5/690 |
| 9,414,682 | B1 * | 8/2016 | Mezzera | A47C 7/34 |
| 10,104,970 | B1 * | 10/2018 | Stiles | A47C 7/34 |
| 2016/0235204 | A1 * | 8/2016 | Andreotti | A47C 7/20 |
| 2017/0079440 | A1 * | 3/2017 | Todd | B62J 1/007 |

* cited by examiner

*Primary Examiner* — David R Dunn
*Assistant Examiner* — Tania Abraham
(74) *Attorney, Agent, or Firm* — Nima Seyedali

(57) ABSTRACT

The present disclosure provides a support device including a body interface layer resting against a user's body, a core adjacent the body interface layer with a plurality of independently acting micro coils surrounded by an enclosure layer, a stabilizing layer more rigid than the enclosure layer and the body interface layer, and an outer layer adjacent the stabilizing layer and which rests against an external surface such as a seat back when the device is in use. The body interface layer includes a curvilinear or parabolic profile with its inflection point toward a central region of the device and tapering toward lateral ends thereof. The body interface layer is thickest toward its intermediate portion which aligns with a central row of the spiral biasing devices, the body interface layer thinner outer intermediate regions aligning with outer spiral biasing device rows, providing for a consistently distributed pressure against the body.

15 Claims, 7 Drawing Sheets

BODY SUPPORT DEVICE AND METHOD

BACKGROUND

Technical Field

The present disclosure generally relates to body support devices, and more particularly, to a body support device including a composite of layers with various properties to provide support for and conform to body contour.

Description of the Related Art

Cushions and body support devices, for example, back support devices to date suffer from various setbacks. For example, those made up of only one piece of foam tend to deteriorate over time losing their effectiveness. Even prior to that point, they provide support typically across a flat surface that result in discomfort for the user due to the user's body being contoured; and therefore, the flat surface transferring inconsistent pressure along the contact surface.

Other such devices made up of multiple layers merely stack various foams that provide some variation in resistance and support however are not sufficient to provide the user comfort for long term support such as while driving long distances or sitting in a chair for long durations.

Yet other support devices combine foam with nodes or cores that are not sufficiently stabilized nor provide independent variable pressure, and therefore, over time lose their shape and ability to support the user's body. Some of these devices are complicated, expensive to make, and difficult to clean.

BRIEF SUMMARY

Figure 1:
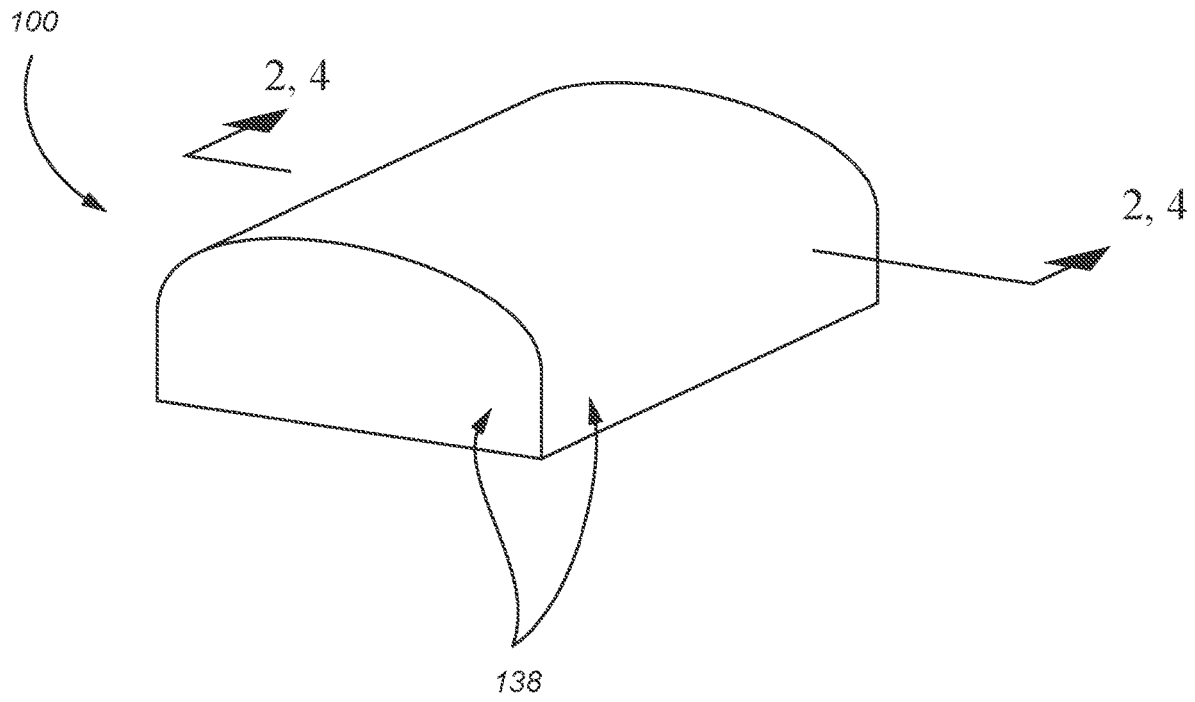
FIG. 1 illustrates an isometric view of a body support device according to one embodiment.

According to one embodiment, a body support device includes a body interface layer having a first side and a second side, the first side resting against a user's body when the device is in use; a core having a first side and a second side, the first side positioned adjacent the second side of the body interface layer, the core including a lateral enclosure layer and a plurality of spiral biasing devices, the lateral enclosure layer having a peripheral portion and an opening, a portion of the second side of the body interface layer positioned contiguous to the peripheral portion, and the spiral biasing devices substantially positioned in the opening; a stabilizing layer having a first side and a second side, the first side positioned adjacent the second side of the core and having a density higher than the density of the enclosure layer and the body interface layer, the spiral biasing devices and the peripheral portion of the enclosure layer deforming more than the stabilizing layer when the body support device is in use; and an outer layer contiguous to the second side of the stabilizing layer and having a density lesser than the density of the stabilizing layer.

According to one aspect, the first side of the body interface layer includes a curvilinear profile having an intermediate region and opposing first and second lateral regions, the intermediate region being positioned between opposing first and second lateral regions and adjacent the plurality of spiral biasing devices, the first and second lateral regions being positioned contiguous the peripheral portion of the enclosure layer.

According to one aspect, the device includes a normal axis; and a first lateral end and a second lateral end opposing the first lateral end, wherein the intermediate region of the body interface layer includes a centermost portion and the curvilinear profile is substantially symmetric about the normal axis with an inflection point thereof occurring at the centermost portion, a thickness of the body interface layer diminishing as the profile thereof moves from the inflection point at the normal axis in opposing directions toward the first and second lateral ends.

According to one aspect, the intermediate region of the body interface layer includes opposing first and second outer intermediate regions on opposing lateral sides of the centermost portion and being respectively thinner than the centermost portion, and the plurality of spiral biasing devices includes a central row aligned with the normal axis and at least first and second outer rows on opposing lateral sides of the central row, the central row being positioned adjacent the centermost portion of the intermediate region of the body interface layer, and the first and second outer rows of the spiral biasing devices being respectively positioned adjacent the first and second outer intermediate regions of the body interface layer.

According to one aspect, the spiral biasing devices contract and extend independently from each other during use, and the curvilinear profile of the body interface layer diminishes as the profile thereof moves from the inflection point at the normal axis in opposing directions toward the first and second lateral ends at a slope such that during use in reaction to the user's body exerting a force centered at the inflection point, a combination of the thickness of the body interface layer and the corresponding one of the central and first and second outer rows of spiral biasing devices produces a substantially constant pressure against the user's body.

According to one aspect, the peripheral portion of the lateral enclosure layer deforms less than the plurality of the biasing devices when the device is in use.

According to one aspect, the body interface layer, the lateral enclosure layer, and the outer layer are fabricated from material having substantially identical densities.

According to one aspect, the body interface layer, the enclosure layer, and the outer layer are fabricated from memory foam and the stabilizing layer is fabricated from compressed foam.

According to one aspect, the plurality of spiral biasing devices each include at least one micro coil.

According to one aspect, the plurality of spiral biasing devices experience at least fifty percent less resilience loss than the body interface layer.

According to one aspect, the plurality of spiral biasing devices contract and extend independently from each other during use.

According to one aspect, each of the body interface layer, lateral enclosure layer, stabilizing layer, and outer layer each have respective thicknesses, the thickness of the body interface layer at its thickest portion being two to three times larger than the thickness of the lateral enclosure layer, the thickness of the lateral enclosure layer being four times larger than the thickness of the stabilizing layer.

According to one aspect, the thickness of the lateral enclosure layer is two times larger than the thickness of the outer layer.

According to another embodiment, a body support apparatus includes a normal axis, a body interface layer substantially centered about the normal axis and having variable thickness, a curvilinear surface and a substantially linear surface, opposing the curvilinear surface along the normal axis, an intermediate region, and first and second lateral end regions respectively positioned adjacent opposing lateral sides of the intermediate region, the varying thickness diminishing from the normal axis toward the first and second lateral end regions, a plurality of rows of biasing devices configured to independently expand and contract, the biasing devices positioned adjacent the substantially linear surface and the intermediate region, and a lateral enclosure layer having a peripheral portion and an opening bounded by the peripheral portion, the peripheral portion surrounding the biasing devices and positioned adjacent the first and second lateral end regions, the lateral end regions being less malleable than the biasing members.

According to one aspect, the body support apparatus further includes a stabilizing layer having a density higher than a density of the lateral enclosure layer and the body interface layer, the stabilizing layer positioned adjacent the plurality of biasing devices and the lateral enclosure layer.

According to one aspect, the material and thickness of the peripheral portion and the body interface layer at the first and second lateral end regions, and a biasing force of the biasing devices, are all selected to promote a substantially constant force experienced by a user at the point of contact between the user and the curvilinear surface when the device is in use.

According to one aspect, the intermediate region of the body interface layer includes a centermost portion and first and second outer intermediate regions respectively positioned adjacent opposing sides of the centermost portion, the thickness of the body interface layer being larger at the centermost portion than the thickness thereof at the first and second outer intermediate regions.

According to one aspect, the plurality of biasing devices includes three rows of biasing devices, each row respectively positioned adjacent the centermost portion and the first and second outer intermediate regions.

DETAILED DESCRIPTION

Figure 2:
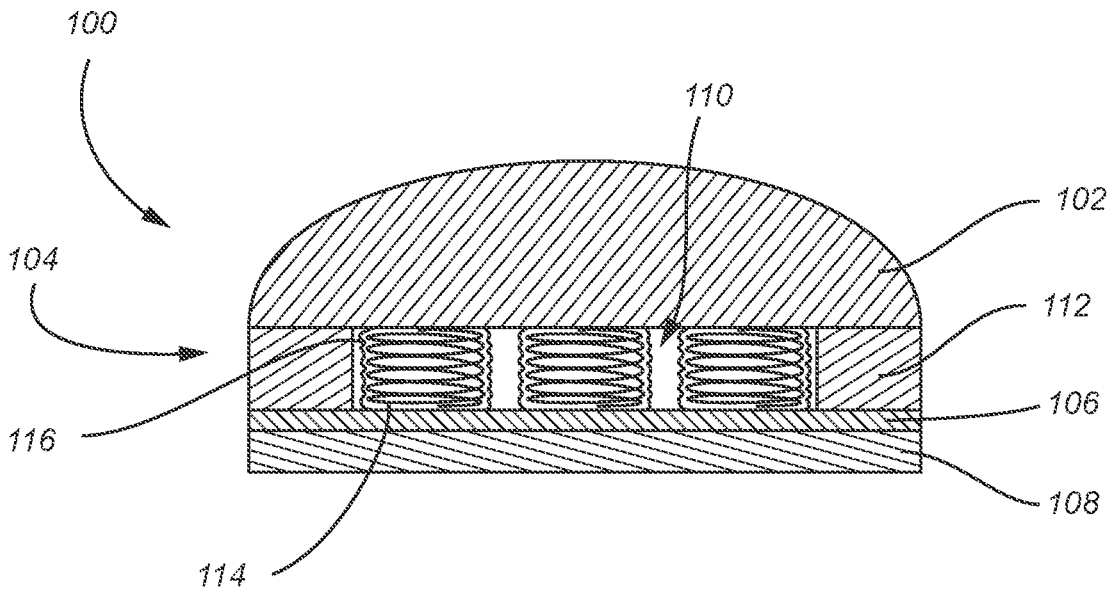
FIG. 2 illustrates a cross-section of the body support device of FIG. 1, according to one aspect, across Section 2-2.

FIG. 1 illustrates one embodiment of a support device 100. As illustrated in FIG. 2, the device 100 in one aspect includes a body interface layer 102, a core 104, a stabilizing layer 106, and an outer layer 108. In one aspect, the core 104 includes a plurality of spiral biasing and/or resistance device 110 and a lateral enclosure 112 having a peripheral portion and a hollow portion or opening 122 (FIG. 3) substantially laterally bound by the peripheral portion. In one embodiment, the spiral biasing devices 110 each includes a coil element 114. In one aspect, the spiral biasing devices 110 could include a mesh wrapping 116 at least partially wrapping the coil element 114.

Figure 3:
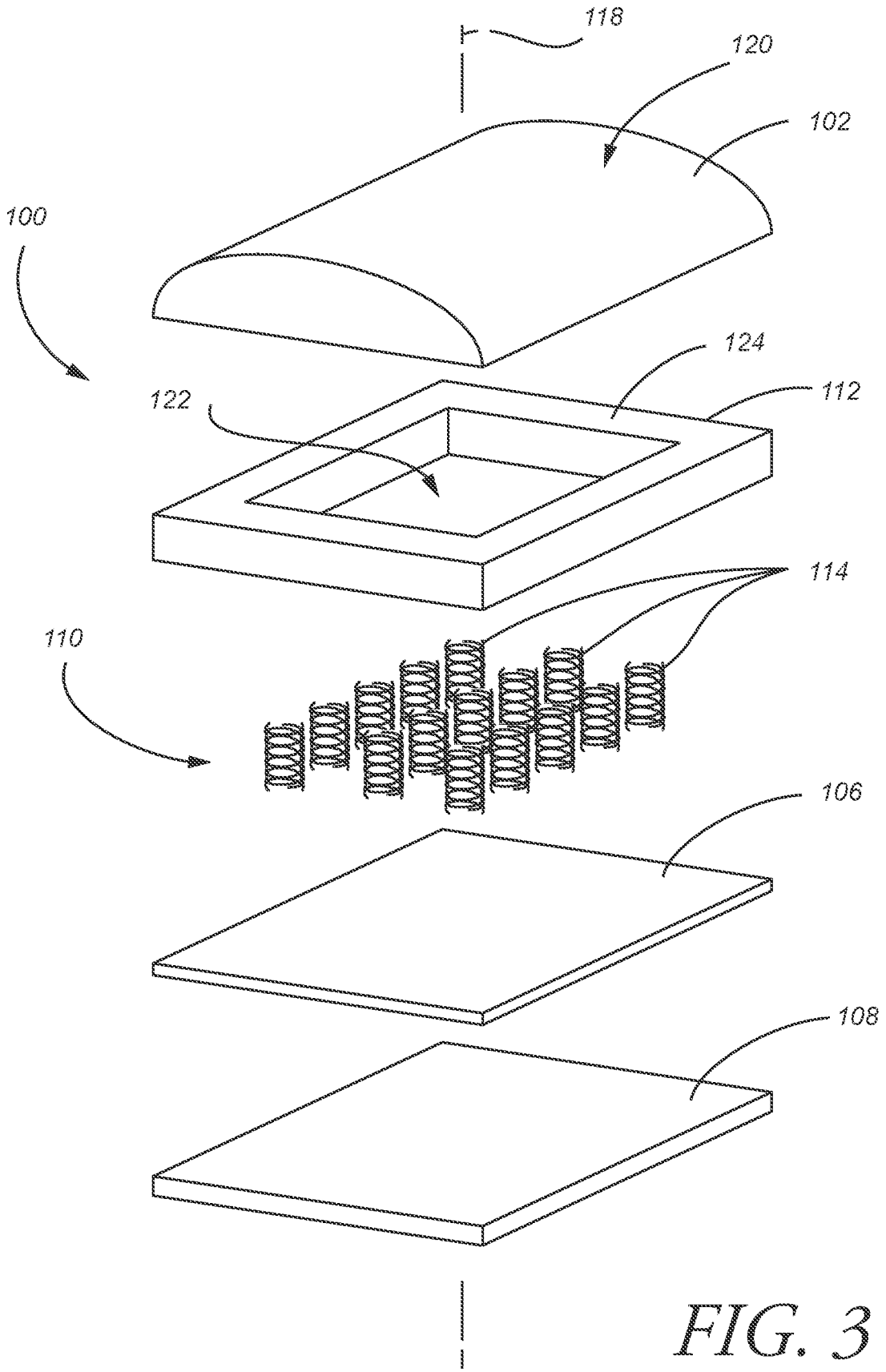
FIG. 3 illustrates an exploded isometric view of the body support device of FIG. 1, according to one aspect.

FIG. 3 illustrates the above members in an exploded view along a normal axis 118 according to one embodiment to more clearly demonstrate a stack-up thereof, which when combined yield a comfortably conforming interface in relation to a user's body.

According to one aspect, the body interface layer 102 includes a curvilinear surface 120 having a curvilinear contour such as a partially circular, elliptical, or parabolic contour. The curvilinear surface 120 interfaces with the user's body when the support device 100 is in use. In one aspect, the body interface layer 102 is fabricated from a material including an open-cell polyurethane-silicon plastic, for example, orthopedic or memory foams. The curvilinear contour of the curvilinear surface 120 maximizes the surface area in contact with the user's body along curved and/or contoured body portions typically benefiting from external support such as neck, back, and underside of knees.

According to one aspect, the lateral enclosure 112 of the core 102 includes the hollow portion 122 that is hollow all the way through its thickness as illustrated in FIG. 3, and a boundary or peripheral portion 124 laterally surrounding the hollow portion 122. In one aspect, the plurality of the spiral biasing devices 110 are positioned adjacently or laterally, with respect to one another and with respect to the normal axis 118, at least partially in and/or along the hollow portion 122. In one embodiment, each spiral biasing device 110 includes a first end adjacent, in contact, or contiguous with the body surface layer 102, and a second end adjacent, in contact, or contiguous with the stabilizing layer 106.

In one aspect, the stabilizing layer 106 is fabricated from a material having higher density or higher weight per unit area, and/or being harder or more rigid, as compared to the body interface layer 102 and the lateral enclosure 112 of the core 102. For example, in one embodiment, the stabilizing layer 106 is fabricated from a material including high-density and/or compressed foam. Therefore, the stabilizing layer 106 exhibits higher resistive attributes compared to the body interface layer 102 and the lateral enclosure 112, serving as a backing thereto and stabilizing them.

In addition, the stabilizing layer 106 serves as a dense anchor for the spiral biasing devices 110 to press against, thereby transferring pressure to the body interface layer 102, which in turn converts that pressure to support against the user's body when the device 100 is in use. Given the plurality of biasing devices 110 can contract and extend independently, they respectively apply pressure to the body interface layer 102 to press the latter against the user's various body contours at a generally constant pressure.

The outer layer 108 in one embodiment is fabricated from a material less dense than the stabilizing layer 106 to provide a resilient and/or force-absorbing contact with a surface on which it rests when the user is using the device 100. Such a surface could include the back of a chair or car seat, the ground in the case of the user laying down, a wall, or any other suitable surface.

An interrelation between the described components of the device 100 facilitates a remarkably more comfortable and effective support for the user's body portions such as back and neck. The description that follows details the relative interaction between these components in certain embodiments, bringing about the advantageous orthopedic benefits for the user.

Figure 4:
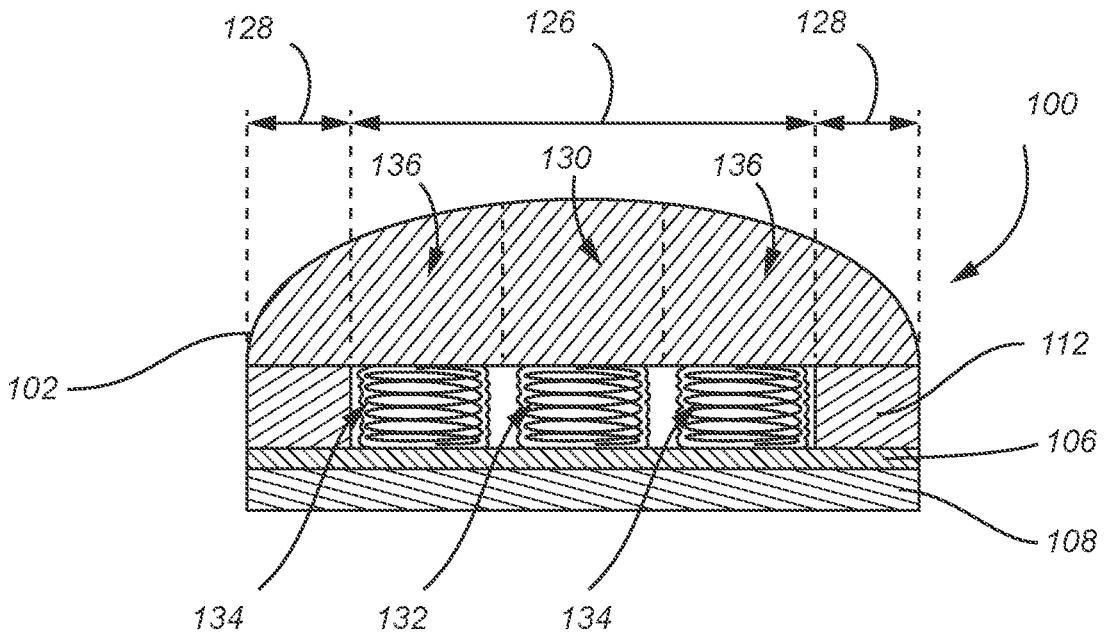
FIG. 4 illustrates a cross-section of the body support device of FIG. 1, according to one aspect, across Section 4-4.

Referring to FIG. 4, the body interface layer 102 is supported on the lateral enclosure 112 on opposing first and second lateral end regions 128 of the body interface layer 102. According to one aspect, the body interface layer 102 includes an intermediate region 126 between the first and second lateral end regions 128. Given the curvilinear profile of the body interface layer 102, the intermediate region 126 being thicker than the first and second end regions 128.

In the illustrated embodiment of FIG. 4, the spiral biasing devices 110 are positioned between the intermediate region 126 of the body interface layer 102 and the stabilizing layer 106. In this manner, the intermediate region 126, when placed under pressure by the user's body, is resiliently supported by the spiral biasing devices 110, which in turn is supported by the stabilizing layer 106 and push back on the intermediate region 126, providing a conforming support for the user's body.

Furthermore, the curvilinear surface 120 normalizes a level of force experienced by the user's body from the body interface layer 102, such that the force against the user's body across the curvilinear surface 120 is generally constant avoiding creation of any hard point that could cause discomfort. Typically, a centermost portion 130 of the intermediate region 126 experiences the highest load from the user's body because the intermediate region 126 is where the user would typically center the body support device 100.

This centermost portion 130 in the illustrated embodiment of FIG. 4 can be aligned with a central row of spiral biasing devices 110 and is also the thickest part of the body interface layer 102. Therefore, in application to back support as in FIG. 5, the body interface layer 102 deforms and absorbs the body force more than thinner portions of the body interface layer 102 adjacent the centermost portion 130 when the force applied from the user's body is centered on the support device 100. Accordingly, in this example, the body weight transmitted to a corresponding central row 132 of spiral biasing devices 110 is less than the body weight transmitted to outer rows 134 of spiral biasing devices 110 on opposing sides of the central row 132.

Hence, given the outer rows 134 of the spiral biasing devices 110 are respectively aligned with portions of the body interface layer 102 that are thinner than the centermost portion 130 thereof, the outer rows 134 exert more pressure back toward the body as compared to the central row 132. Given the centermost portion 130 is thicker and deforms more than outer intermediate regions 136 adjacent to it on the body interface layer 102, the centermost portion 130 has higher potential energy pressing back on the body compared to the outer intermediate regions 136. Therefore, this additional pressure on the body in the centermost portion 130 plus the lesser force exerted by the central row 132 of the spiral biasing devices 110 generally aligns with the thinner less deformed outer intermediate regions 136 plus the higher force exerted by the outer rows 134 of the spiral biasing devices 110.

Therefore, the support device 100 conforms to back contour of the user's body and the user experiences a generally constant and conforming support from the body support device 100. The normal axis 118 (FIG. 3) coincides with an inflection point of the curvilinear surface 120, which occurs at the centermost portion 130, a thickness of the body interface layer 102 diminishing as the profile thereof moves from the inflection point in opposing directions toward first and second lateral ends of the device 100.

It is understood that the support device 100 could behave differently when used on various body contours, and the independently contracting spiral biasing devices 110 and curvilinear body interface layer 102 cooperate to snugly conform to the specific part of the body and its contours.

In one embodiment, as discussed above, the body interface layer 102 is supported on the lateral enclosure 112 on opposing first and second lateral end regions 128 of the body interface layer 102. The lateral enclosure 112 provides a firm yet resilient seat for the lateral end regions 128. Given the lateral end regions 128 of the body interface layer 102 are the thinnest portions thereof and the lateral enclosure 112 is more firm or rigid, or less malleable or less deformable, compared to the spiral biasing members 114, this firm seat maintains their position without allowing excess deformation to facilitate a wrap-around feel for the user toward opposing lateral end regions of the support device 100, and complement the intermediate region 126 to provide a substantially constant pressure distribution on the user's contoured body.

As discussed above, in one aspect, the stabilizing layer 106 is fabricated from a material having higher density or higher weight per unit area, and/or being harder or more rigid, as compared to the body interface layer 102 and the lateral enclosure 112 of the core 102, such as high-density and/or compressed foam. Therefore, the lateral enclosure 112 and the spiral biasing devices 110 press against a firm seat, namely, the stabilizing layer 106, so that when the user for example leans back on the support device 100, the resilience of the lateral enclosure 112 and the spiral biasing devices 110 are optimally leveraged. In this manner, the lateral enclosure 112 and the spiral biasing devices 110 do not yield excessively, and respond or press against the user's body with optimal pressure.

Further as discussed above, the outer layer 108 in one embodiment is fabricated from a material less dense than the stabilizing layer 106 to provide a resilient and/or force-absorbing contact with a surface on which it rests when the user is using the device 100. Such a surface could include the back of a chair or car seat, the ground in the case of the user laying down, a wall, or any other suitable surface. For example, the outer layer 108 can be fabricated from foam or memory foam. Therefore, the outer layer 108 can also facilitate conforming to variously shaped contours such as a concave seat back surface.

Figure 5:
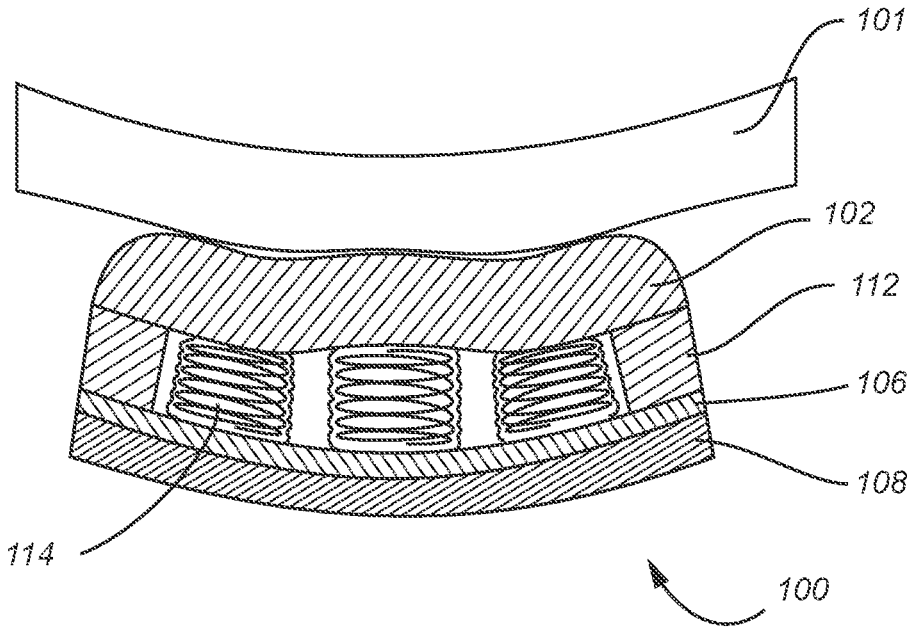
FIG. 5 illustrates a cross-section of the body support device of FIG. 1 during use, according to one aspect.

For example, as illustrated in FIG. 5, in the case where a user 101 uses the body support device 100 to support and relieve lower back, the user can position the device 100 such that the centermost portion 130 (FIG. 4) of the body interface layer 102 is contacting the user's spine area in the user 101 back concavity, and the outer intermediate regions 136 (FIG. 4) are positioned adjacent opposing sides of the spine area. Given the explanation above of the support device 100 operation, the body interface layer 102 forms a snug fit, applying a generally constant pressure across the interface between the device 100 and the user 101 lower back. As illustrated in FIG. 5, the center row 132 (FIG. 4) of biasing devices 110 and the outer rows 134 (FIG. 4) can extend and contract independently to conform to the user 101 body contour. In this manner, the relative potential energy in the biasing devices 110 of the central and outer rows 132, 134 (FIG. 4) promotes a constant pressure against the body transferred through the body interface layer 102 as discussed above.

Additionally, the combination of elements described facilitates the longevity of the support device 100 without it experiencing excessive deformation over repeated use in the long run. In the support device 100, the spiral biasing devices 110 (FIG. 3) collectively experience the bulk of the cyclic pressure loading from the user's body, as compared to the lateral enclosure 112 because they are located adjacent where the body pressure is applied. Furthermore, the spiral biasing devices 110 such as coils and micro coils experience resilience loss over time of more than 50%, for example about 60%, less than the body interface layer 102 such as memory foam. Given this relationship over time, the device 100 experiences substantially constant resilience loss over time, therefore, maintaining its shape and not deforming.

In any embodiment any one or more of the body interface layer 102, lateral enclosure 112, stabilizing layer 106, and/or outer layer 108 can be fabricated from a material including polymers and/or any one or more of expanded polystyrene, polyethylene, polyurethane, polyol, polyisocyanates, and/or any other suitable foam material or porous material.

In various embodiments, the support device 100 elements described above could be fabricated from dimensions or dimension proportions relative to one another to further promote a consistently distributed pressure on the user's body. In one example embodiment, the body interface layer 102 could have a thickness that is two to three times the thickness of the core 104, the core 104 having a thickness four times thicker than the stabilizing layer 106 and two times the outer layer 108.

In some embodiments, as illustrated in FIG. 1, the support device 100 includes an outer fitting or cover 138 configured to fixedly or removably wrap around to contain the various elements of the support device 100. The outer cover 138 can be fabricated from leather, cloth, plastics, cotton, suede, other fabric, or any other suitable material.

In some embodiments, the body interface layer 102 can incorporate channels, reservoirs, and/or storage areas or pouches configured to receive, or containing, material or fluids with thermal properties such that when the body interface layer 102 is heated or cooled, it retains that temperature. When in use, the support device 100 then can further sooth the user's body problem areas such as back or neck.

In some embodiments, the body interface layer 102 and/or the support device 100 can include a power source configured to operate a vibration device, the vibration device configured to selectively impart vibration or vibration patterns to the user's body when in use.

In some embodiments, the core 104 and/or the support device 100 can include a power source to operate an actuator, the actuator being operatively coupled to the spiral biasing devices and configured to contract and detract the spiral biasing devices 110 in unison, in a pattern, and/or randomly.

Figure 6:
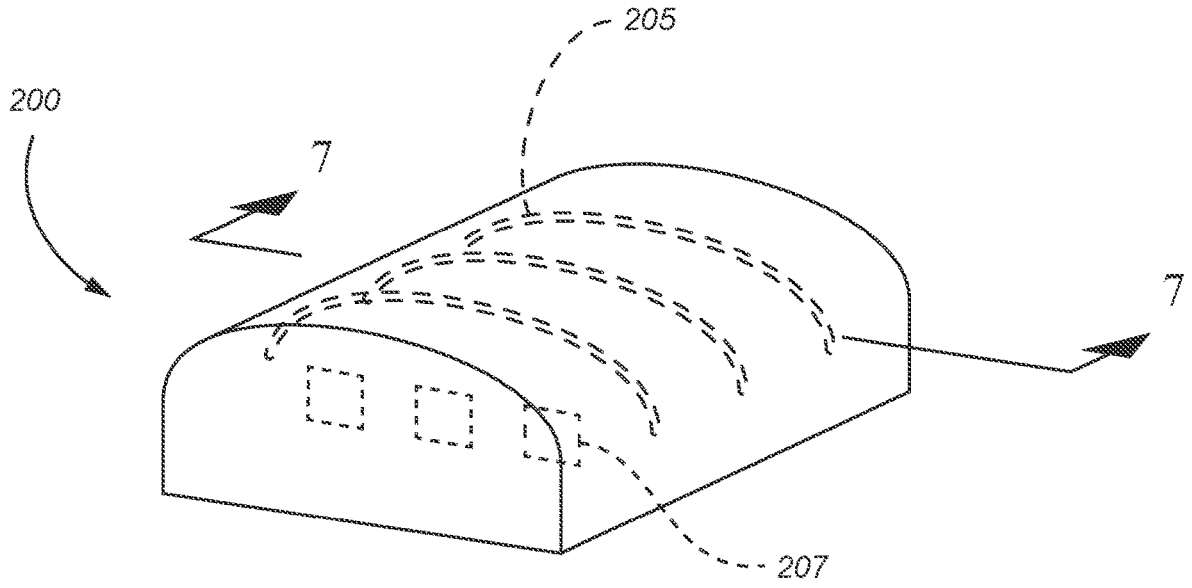
FIG. 6 illustrates an isometric view of a body support device according to one embodiment.
Figure 7:
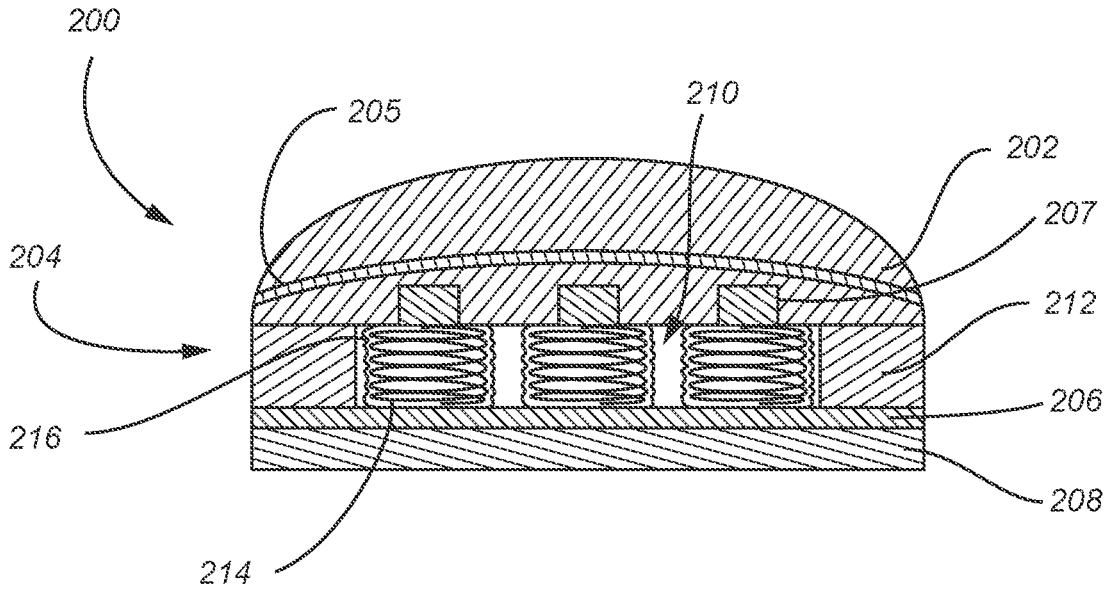
FIG. 7 illustrates a cross-section of the body support device of FIG. 6, according to one aspect, across Section 7-7.

FIGS. 6 and 7 illustrate a support device 200 according to one embodiment. Similarly numbered components are analogous to corresponding components of the embodiments illustrated in FIGS. 1 through 5. According to one aspect, the support device 200 further includes at least one thermal element 205. The thermal element 205 can include a housing or tube routing thermal material or fluid and/or having thermal properties that assist in soothing the user's muscle tension.

For example in one embodiment, the thermal element 205 can include certain thermal material, which when under pressure of user's body, can exhibit heat or cold. In another aspect, the thermal element 205 can include thermal fluid routed through a tube and when the support device 200 is heated or cooled, the thermal fluid sustains heat or cold during use of the support device 200.

In such embodiments, the heat can aid in soothing spasms in the affected body region while the cold can reduce inflammation, in addition to the advantages above discussed with respect to the illustrated embodiment in FIGS. 1 through 5.

According to one embodiment, the support device 200 can include one or more vibrating elements 207 that can be electrically powered for example by battery and/or power cord plugged in an outlet. The vibrating elements 207 can include a connector or element that routes electrical power to the vibrating element 207 when the user applies pressure to the support device 200. In such an embodiment, the user can benefit from the advantages described above with respect to FIGS. 1 through 5 while additionally experiencing vibration to promote blood flow in the affected body region.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A body support device comprising:

a first lateral end and a second lateral end opposing the first lateral end;

a body interface layer having a first side and a second side, the first side resting against a user's body when the device is in use, body interface layer having an intermediate region including a curvilinear profile with an inflection point in the first side, a centermost portion, first and second outer intermediate regions respectively on the opposing lateral sides of the centermost portion, a thickness of the body interface layer diminishing as the curvilinear profile thereof moves from the inflection point in opposing direction toward the first and second lateral ends; and a stabilizing layer having a first side and a second side;

a core positioned between the stabilizing layer and the body interface layer, the core including a lateral enclosure layer and a plurality of spiral biasing devices, the lateral enclosure layer having a peripheral portion and an opening, the spiral biasing devices at least partially positioned in the opening and between the intermediate region of the body interface layer and the stabilizing layer, and including a central row and at least first and second outer rows on the opposing lateral sides of the central row, the central row aligned with the centermost portion of the intermediate region of the body interface layer, and the first and second outer rows of the spiral biasing devices being respectively aligned with the first and second outer intermediate regions of the body interface layer, the curvilinear profile of the body interface layer diminishing from the inflection point opposing directions toward the first and second lateral ends at a rate such that during use in reaction to the user's body exerting a force centered at the inflection point, a combination od the resilience in the thickness of the body interface layer and the corresponding one of the central and first and second outer rows of the spiral biasing devices produces a substantially constant pressure against the user's body.

2. The device of claim 1, further comprising:

an outer layer adjacent to the second side of the stabilizing layer.

3. The device of claim 2 wherein the body interface layer, the lateral enclosure layer, and the outer layer are fabricated from material having substantially identical densities.

4. The device of claim 3 wherein the body interface layer, the enclosure layer, and the outer layer are fabricated from memory foam and the stabilizing layer is fabricated from compressed foam.

5. The device of claim 1 wherein the body interface layer includes opposing first and second lateral regions, the intermediate region positioned between opposing first and second lateral regions and the first and second lateral regions positioned adjacent the peripheral portion of the lateral enclosure layer.

6. The device of claim 5, further comprising:

a normal axis wherein the curvilinear profile is substantially symmetric about the normal axis.

7. The device of claim 1 wherein the plurality of spiral biasing devices each include at least one micro coil.

8. The device of claim 1 wherein the plurality of spiral biasing devices experience at least fifty percent less resilience loss than the body interface layer.

9. The device of claim 1 wherein the plurality of spiral biasing devices contract and extend independently from each other during use.

10. The device of claim 1 wherein each of the body interface layer, lateral enclosure layer, stabilizing layer, and outer layer each have respective thicknesses, the thickness of the body interface layer at its thickest portion being two to three times larger than the thickness of the lateral enclosure layer, the thickness of the lateral enclosure layer being four times larger than the thickness of the stabilizing layer.

11. The device of claim 10 where the thickness of the lateral enclosure layer is two times larger than the thickness of the outer layer.

12. The device of claim 1 wherein the body support device includes an outer fitting configured removably wrap around the body interface layer, core, and stabilizing layer.

13. A body support device comprising:

a normal axis;

a first lateral end and a second lateral end opposing the first lateral end;

a body interface layer having a first side and a second side, the first side resting against a user's body when the device is in use;

a core having a first side and a second side, the first side positioned adjacent the second side of the body interface layer, the core including a lateral enclosure layer and a plurality of spiral biasing devices, the lateral enclosure layer having a peripheral portion and an opening, a portion of the second side of the body interface layer positioned contiguous to the peripheral portion, and the spiral biasing devices substantially positioned in the opening; and a stabilizing layer having a first side and a second side, the first positioned adjacent the second side of the core and having a density higher than the density of the lateral enclosed layer and the body interface layer, the spiral biasing devices and the peripheral portion of the lateral enclosure layer deforming more than the stabilizing layer when the body support device is in use, wherein:

the first side of the body interface layer includes a curvilinear profile having an intermediate region and opposing first and second lateral regions, the intermediate region positioned between opposing first and second lateral regions and adjacent the plurality of spiral biasing devices, the first and second lateral regions positioned contiguous the peripheral portion of the lateral enclosure layer;

the intermediate region if the body interface layer includes a centermost portion and the curvilinear profile is substantially symmetric about the normal axis with an inflection point thereof occurring at the centermost portion, a thickness of the body interface layer diminishing as the profile thereof moves from the inflection point at the normal axis in opposing directions toward the first and second lateral ends;

the intermediate region of the body interface layer includes opposing first and second outer intermediate regions on opposing lateral sides of the centermost portion and being respectively thinner than the centermost portion, and the plurality of spiral biasing devices includes a central row aligned with the normal axis and at least first and second outer rows on opposing lateral sides of the central row, the central row being positioned adjacent the centermost portion of the intermediate region of the body interface layer, and the first and second outer rows of the spiral biasing devices being respectively positioned adjacent the first and second outer intermediate regions of the body interface layer.

14. The device of claim 13 wherein the spiral biasing devices contract and extend independently from each other during use, and the curvilinear profile of the body interface layer diminishes as the profile thereof moves from the inflection point at the normal axis in opposing directions toward the first and second lateral ends at a slope such that during use in reaction to the user's body exerting a force centered at the inflection point, a combination of the thickness of the body interface layer and the corresponding one of the central and first and second outer rows of spiral biasing devices produces a substantially constant pressure against the user's body.

15. The device of claim 14 wherein the peripheral portion of the lateral enclosure layer deforms less than the plurality of the biasing devices when the device is in use.

* * * * *